United States Patent [19]

Servay

[11] Patent Number: 4,765,035

[45] Date of Patent: Aug. 23, 1988

[54] BELT BUCKLE ATTACHMENT CLAMP

[75] Inventor: Willy Servay, Montreal, Canada

[73] Assignee: Century Products Ltd., Quebec, Canada

[21] Appl. No.: 58,869

[22] Filed: Jun. 5, 1987

[51] Int. Cl.[4] ..... A44B 11/00

[52] U.S. Cl. ..... 24/265 A; 24/198

[58] Field of Search ..... 24/265 A, 265 C, 170, 24/198, 671, 674, 689; 160/383, 402

[56] References Cited

U.S. PATENT DOCUMENTS

| | | | |
|---|---|---|---|
| 209,701 | 11/1878 | McGill | 24/265 A |
| 445,491 | 1/1891 | Biesen | 24/265 A |
| 943,135 | 12/1909 | Boyer | 24/265 A |
| 2,140,333 | 12/1938 | Reiter | 24/265 A |
| 2,267,585 | 12/1941 | Churchill | 24/265 A |
| 2,780,851 | 2/1957 | Grais | 24/265 A |
| 3,030,685 | 4/1962 | Reiter | 24/265 A |
| 3,124,095 | 3/1964 | Kanser | 24/265 A |

*Primary Examiner*—Victor N. Sakran
*Attorney, Agent, or Firm*—Oblon, Fisher, Spivak, McClelland & Maier

[57] ABSTRACT

A belt buckle attachment clamp for connecting a buckle to an end of a belt. The attachment clamp comprises a metal piece defining a top wall having integrally formed a pair of spaced apart fingers extending from a forward edge thereof. A space is defined between the fingers for accommodating a buckle swivel pin hingedly secured to a buckle arm. The fingers are deformable to clamp about the buckle arm. A clamping flange is formed integrally with a respective one of opposed side edges of the top wall. Gripping prongs extend above an inner face of at least one of the clamping flanges. The flanges are bendable rearwardly of the top wall and spaced therefrom to define a belt end receiving throat to attach the attachment clamp to a belt end by pressing the clamping flanges on the belt end to cause the clamping flanges and the gripping prongs to grip the belt end.

5 Claims, 2 Drawing Sheets

BELT BUCKLE ATTACHMENT CLAMP

BACKGROUND OF THE INVENTION

1. Field of the Invention

The present invention relates to an improved belt buckle attachment clamp which is easily attachable to a buckle and the end of a belt, and wherein the attachment clamp is formed with a single metal piece.

2. Description of the Prior Art

The conventional manner of securing a belt end to a buckle is to loop an end of the belt about a buckle arm containing a swivel pin. In order to do so, it is also necessary to slot the belt to accommodate the swivel pin which is hingedly secured to the buckle arm. The overlapped end portions of the belt are then secured together by suitable fastening means, such as rivets or stitching. A belt retention loop may also be secured close to the buckle end at the same time that this operation is effected. A disadvantage of such belt buckle attachment is that it is time consuming and the securement of the belt end to the buckle is not always done properly. Further, such securement is not always aesthetically pleasing.

SUMMARY OF THE INVENTION

It is a feature of the present invention to provide a belt buckle attachment clamp which substantially overcomes the above disadvantages of the prior art.

Another feature of the present invention is to provide a belt buckle attachment clamp which is die-formed from a single piece of metal, and which does not require fasteners for the securement of same to a belt free end or to a buckle.

Another feature of the present invention is to provide a belt buckle attachment clamp which is aesthetically pleasing and wherein a belt retention loop may be formed integrally therewith.

Another feature of the present invention is to provide a belt buckle attachment clamp which is easily and quickly attached to a belt buckle and to a free end of a belt.

According to the above features, from a broad aspect, the present invention provides a belt buckle attachment clamp for connecting a buckle to an end of a belt. The attachment clamp comprises a metal piece defining a top wall having integrally formed a pair of spaced apart fingers extending from a forward edge thereof. A space is defined between the fingers for accommodating a buckle swivel pin hingedly secured to a buckle arm. The fingers are deformable to clamp about the buckle arm. A clamping flange is formed integrally with a respective one of opposed side edges of the top wall. Gripping means extend above an inner face of at least one of the clamping flanges. The flanges are bendable rearwardly of the top wall and spaced therefrom to define a belt end receiving throat to attach the attachment clamp to a belt end by pressing the clamping flanges on the belt end to cause the clamping flanges and the gripping means to grip the belt end.

BRIEF DESCRIPTION OF DRAWINGS

A preferred embodiment of the present invention will now be described with reference to the examples thereof as illustrated in the accompanying drawings, in which.

DESCRIPTION OF PREFERRED EMBODIMENTS

Figure 1:
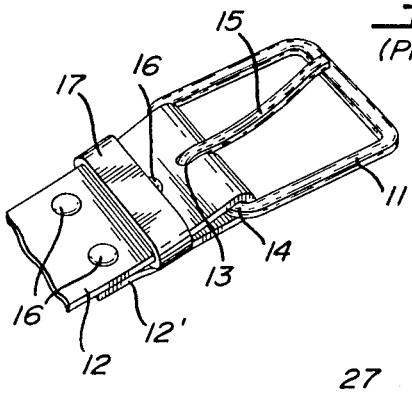
FIG. 1 (PRIOR ART)
FIG. 1 is a perspective view illustrating a prior art method of attaching a belt buckle to a belt end.

Referring now to the drawings, and more particularly to FIG. 1, there is shown a prior art belt buckle 11 secured to a belt end 12. As herein shown, a portion of the belt end is provided with a slot 13 therein and looped about a buckle arm 14 to which is connected a swivel pin 15. To do this the swivel pin 15 is passed through a slot 13 and the belt end looped about the arm 14. The overlapped portion 12' of the belt end 12 is then secured to the adjacent belt portion by means of rivets 16, or other suitable means not shown, such as stitching. A retention loop 17 may be secured before the riveting operation. this is a time consuming assembly which is substantially obviated by the novel belt buckle attachment clamp of the present invention which is illustrated in the remaining drawings.

Referring now to FIGS. 2 to 5, there is shown one example of the belt buckle attachment clamp 20 of the present invention. As herein shown, the belt buckle attachment clamp is formed of a metal piece which is die-stamped and defines a top wall 21 having integrally formed a pair of spaced apart flanges or fingers 22 extending from a forward edge of the top wall 21. A space 23 is defined between the fingers and merges into a notch 24 formed in the front edge of the top wall for accommodating a swivel pin 25 when the fingers 22 are clamped about the buckle arm 26 of buckle 27. A clamping flange 28 is also formed integrally with respect to one of opposed side edges of the top wall 21.

Figure 3:
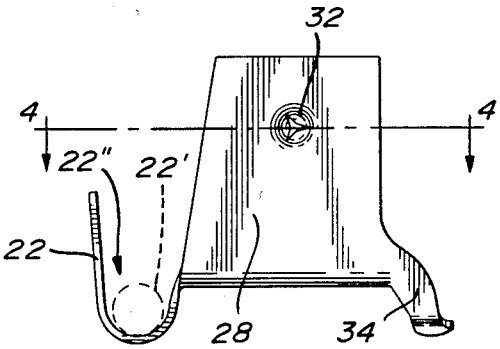
FIG. 3 is a side view of one example of the belt buckle attachment clamp of the present invention, shown in unassembled form.
Figure 4:
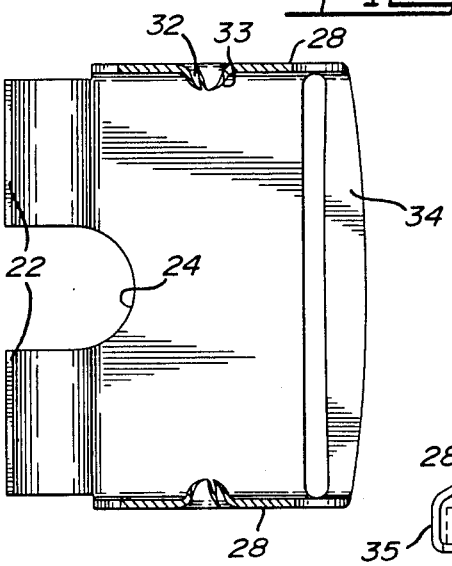
FIG. 4 is a top view along section lines IV—IV of FIG. 3.
Figure 5:
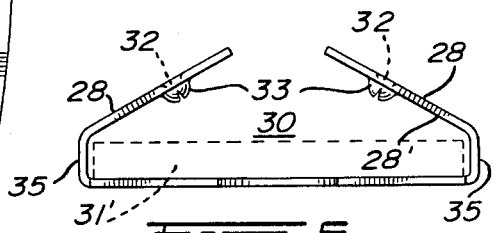
FIG. 5 is an enlarged section view showing the throat portion of the attachment clamp for receiving and connecting to a belt end.

As shown in FIGS. 3 and 4, the buckle attachment clamp is usually formed with the fingers 22 bent to form an open loop to accommodate a buckle arm therein. The loop fingers 22 are then bent over, as shown in phantom lines 22', to secure same to the buckle arm 26. The clamping flanges 28 may also be bent rearwardly of the top wall 21 and lie transverse thereto, as shown in FIGS. 3 and 4, or else disposed in the manner as shown in FIG. 5 to define a belt end receiving throat portion 30 between opposed edge walls 35, which are at least as high as the thickness of the belt whereby to receive the free end portion 31' of the belt 31. The clamping flanges 28 are also bent inwardly toward one another to facilitate clamping.

At least one, but preferably both, of the clamping flanges 28 are provided with gripping means in the form of prongs 32 which are formed therein by punching a hole in these clamping flanges from the outer surface thereof so that the pointed ends 33 of the prongs extend above an inner surface 28' of the clamping flanges. Accordingly, when the clamping flanges are folded over the belt end portion 31' (see FIG. 5), these pointed ends 33 will penetrate into the belt end and hold it secure. Of course, the pressure applied to the belt end by the clamping flanges 28 also provide a retention force to prevent the belt end from slipping out of the attachment clamp.

Figure 2:
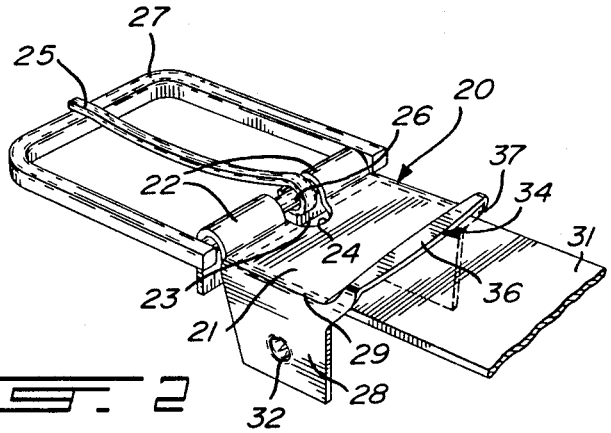
FIG. 2 is a perspective view showing the belt buckle attachment clamp of the present invention for securement to a buckle and a belt end.

As shown in the embodiment of FIG. 2, the attachment clamp 20 may also be provided with an integrally formed belt retention loop 34 which extends from a rear edge corner of the top wall 21. The retention loop 34 has a bridge arm 36 and depending side arms 37 which are spaced apart at least the width of the waist belt 31.

Figure 6:
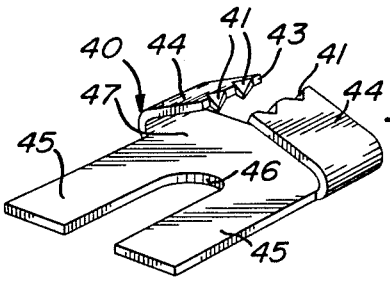
FIG. 6 is a perspective view of another example of a belt buckle attachment clamp of the present invention.
Figure 7:
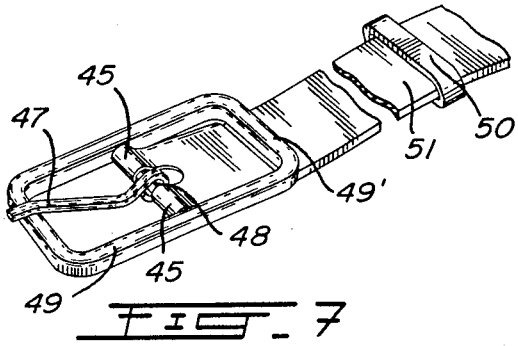
FIG. 7 is a perspective view showing the belt buckle attachment clmap of FIG. 6 secured to a belt buckle and a belt end.

Referring now to FIGS. 6 and 7, there is shown another example of the belt buckle attachment clamp 40 of the present invention. As herein shown, the clamp 40 is also formed from die-stamping, but the gripping means is provided by notches 41 formed in the free end edge 43 of the opposed clamping flanges 44. The fingers 45 are provided as flat extensions with the notch 46 extending therebetween to accommodate the swivel pin of a belt buckle. This attachment clamp is particularly for use with belt buckles of the type as illustrated in FIG. 7 where the swivel pin 47 is hinged to a bridge arm 48 of a loop buckle 49. The belt end retention loop may be provided by securing a loop 50 to the belt 51, or else be provided simply by the end arm 49' of the loop buckle 49.

To assembly the belt buckle 20 or 40 of the present invention, it is only necessary to position the buckle arm 26 or 48 in the throat portion 22'' (see FIG. 3) of the fingers 22 or 45, and then fold the fingers over the buckle arm, as shown at 22'. The belt free end 31' is then inserted in the throat opening 30 or 47 and the clamping flanges 28 or 44 are then folded thereover by suitable means, such as clamps or pliers, not shown, causing the gripping teeth 33 or 41 to penetrate into the material of the belt end 31 thereby attaching the buckle 27 to the belt end.

It is within the ambit of the present invention to cover any obvious modifications of the preferred embodiment described herein, provided such modifications fall within the scope of the appended claims.

I claim:

1. A one-piece metal belt buckle attachment clamp stamping for connecting a buckle to an end of a belt, said attachment clamp comprising a metal piece defining a top wall having integrally formed a pair of spaced apart fingers extending from a forward edge thereof, a space between said fingers for accommodating a buckle swivel pin hingedly secured to a buckle arm, said fingers being formed by elongated flat metal extensions of said top wall, said fingers being crimped rearwardly of said top wall to form loops about said buckle arm and permitting said buckle arm to axially rotate therein, said space between said fingers extending into a notch formed in said forward edge of said top wall, and a clamping flange formed integrally with a respective one of opposed side edges of said top wall, a prong formed in and extending above an inner face of each said clamping flanges, said prong being formed by at least one punch hole formed in each said clamping flanges from an outer surface thereof and forming gripping teeth about said hole extending above an inner surface of said clamping flanges, said flanges being bendable rearwardly of said top wall and spaced therefrom to define a belt end receiving throat to attach said attachment clamp to a belt end by pressing said clamping flanges on said belt end to cause said clamping flanges and said gripping means to grip said belt end, a retention loop extending from a rear edge of said top wall, said retention loop having a bridge arm portion extending elevated above said top wall, and depending side arms spaced apart at least the width of said waist belt.

2. A belt buckle attachment clamp as claimed in claim 1 wherein said clamping flanges are bent rearwardly of said front wall and each define a rearward edge wall portion extending at least the thickness of said belt end, and clamping portions extending angularly rearwards toward one another, said belt end receiving throat being defined between said opposed rearward edge walls.

3. A belt buckle attachment clamp as claimed in claim 2 wherein said buckle arm is an arm portion of a loop buckle.

4. A belt buckle attachment clamp as claimed in claim 2 wherein said buckle arm is a bridge arm of a loop buckle and extending across an open inner area of said loop buckle.

5. A belt buckle attachment clamp as claimed in claim 2 wherein said clamping flange extends the full length of said opposed side edges of said top wall.

* * * * *